United States Patent [19]

Matsumoto et al.

[11] 4,175,919

[45] Nov. 27, 1979

[54] GAS BURNER

[75] Inventors: Michiaki Matsumoto, Tokyo; Juichi Honda, Fujisawa; Sadao Mimori, Saitama, all of Japan

[73] Assignee: Hitachi, Ltd., Japan

[21] Appl. No.: 802,462

[22] Filed: Jun. 1, 1977

[30] Foreign Application Priority Data

Jun. 4, 1976 [JP] Japan ..... 51/64516

[51] Int. Cl.[2] ..... F23D 15/02

[52] U.S. Cl. ..... 431/114; 431/8; 431/351

[58] Field of Search ..... 431/10, 8, 352, 351, 431/328, 174, 175, 176, 178, 114, 419, 568, 425

[56] References Cited

U.S. PATENT DOCUMENTS

| | | | |
|---|---|---|---|
| 3,411,857 | 11/1968 | Peredi | 431/178 |
| 3,718,426 | 2/1973 | Harris | 431/328 |
| 4,035,137 | 7/1977 | Arand | 431/174 |

FOREIGN PATENT DOCUMENTS

| | | | |
|---|---|---|---|
| 1016560 | 1/1966 | United Kingdom | 431/352 |
| 1388695 | 3/1975 | United Kingdom | 431/182 |

*Primary Examiner*—Edward G. Favors

*Attorney, Agent, or Firm*—Craig and Antonelli

[57] ABSTRACT

A gas burner of a low noise, high load combustion type, which produces a flame of a mixture gas prepared or mixed preliminarily. In this burner, an inner flame of a laminar flow is formed and then secondary air of a turbulent flow is supplied to an outer flame portion of a trailing stream of the inner flame from secondary air ports. The inner flame is provided in the form of a laminar flame, and secondary air is thus supplied to an outer flame portion of the inner flame, so that combustion takes place at a low noise level. In addition, since the secondary air is supplied at a turbulent flow, the secondary air may be fixed with an outer flame quickly, thus enabling high load burning or combustion. Furthermore, in case secondary air is supplied from secondary air ports in the form of a laminar flow at a relatively high flow velocity, and then rendered turbulent, downstream of the secondary air ports, then the size of a burner may be reduced, with an accompanying simplified construction.

23 Claims, 17 Drawing Figures

| | SM mm | SA mm | B mm | L mm | D/SA |
|---|---|---|---|---|---|
| A | 1 | 1 | 2 | 0 | 3.0 |
| B | 1 | 1 | 3.2 | 0 | 4.2 |
| C | 1 | 1 | 3.2 | 6 | 4.2 |

GAS BURNER

BACKGROUND OF THE INVENTION

This invention relates to a preliminary mixing type gas burner, which enables a low noise, high load combustion, and more particularly to a gas burner which is used as domestic gas fixture.

There has been a demand for a domestic use of a high load combustion burner which produces low noise and is compact in size to fulfill a space requirement. However, there has been proposed no low noise, high load combustion gas burner in the past.

In a conventional type high load combustion gas burner, combustion of a turbulent nature takes place, resulting in high combustion noise. On the contrary, a burner of a low noise type tends to result in low load combustion.

A description will be made for conventional type gas burners of a low noise combustion type and a high load combustion type with reference to FIGS. 1 and 2.

FIG. 1 shows a gas burner, in which low-noise combustion takes place. Shown at 1 is a mixture gas passage for a mixture gas of gaseous fuel and primary air, with one end of the passage 1 being communicated with a mixture gas inlet 2, and the other end thereof forming a flame hole 3.

In operation, a mixture of primary air and gaseous fuel is supplied through the mixture inlet 2, then through the mixture passage 1 and out of a flame hole 3, thereby providing an inner flame 4 of a laminar flow and an outer flame 5 containing a large amount of $H_2$ and CO in its trailing stream. A secondary air 6 flows along the outer periphery of the flame hole 3 at a flow velocity as low as 0.2 to 0.3 m/s and then is diffused and mixed with the outer flame 5. In this case, the inner flame 4 is provided in the form of a laminar flow, thus producing less combustion noise. Gas and primary air are mixed beforehand, so that the velocity of reaction takes place quickly, in which fuel in the inner flame 4 is decomposed into CO, $H_2$ and the like, and hence a size of the inner flame 4 may be reduced. However, the outer flame 5 containing a large amount of CO and $H_2$ is mixed with secondary air according to molecular diffusion, so that the size of the outer flame 5 is governed by a molecular diffusion velocity. However, a diffusion velocity is relatively low, taking a time as long as 100 to 200 ms, before the outer flame 5 is mixed with the secondary air completely, so that the size of an outer flame should be increased. As a result, a burner of this type provides a relatively low noise level, but suffers from a relatively small combustion-chamber load of an order of $10^6$ kcal/(h.m$^3$).

FIG. 2 shows a gas burner of a high load combustion type. Shown at 1 is a mixture passage, with one end thereof being communicated with a mixture gas inlet 2, and the other end thereof having a plurality of mixture gas swirl vanes or blades 7. A secondary air passage 8 surrounds an outer periphery of the mixture gas passage 1, with one end of the passage 8 being communicated with a secondary air inlet 9, and the other end thereof being provided with secondary air swirl vanes or blades 10 in the neighborhood of an outer periphery of the mixture gas swirl blades 7.

In operation, primary air and gaseous fuel are supplied through the mixture gas inlet 2, then through the mixture gas passage 1 and out of the mixture gas swirl blades 7 in the form of a swirl. Secondary air is supplied through a secondary air inlet 9 and flows out of secondary air swirl blades 10 in the form of a swirl, followed by quick and vigorous mixing of secondary air and mixture gas. According to the burner of this type, a mixture gas is vigorously mixed with the secondary air, with the resulting quick decomposition of fuel into $H_2$, CO and the like, as well as quick oxidation of CO and $H_2$ into $CO_2$ and $H_2O$, thus allowing a high load combustion on the order of $10^7$ kcal (h·m$^3$). However, turbulence takes place, when fuel is decomposed into CO, $H_2$ and the like, so that high combustion noise is produced. This has been clarified theoretically.

OBJECT OF THE INVENTION

It is an object of the present invention to provide a gas burner which allows low noise, high load combustion.

DETAILED DESCRIPTION OF THE PREFERRED EMBODIMENTS

According to the present invention, a gas burner which produces a flame of a mixture gas prepared or mixed preliminarily is used, in a manner that an inner flame of a laminar form is formed for reducing a noise level, while secondary air in the form of turbulence is supplied to an outer flame portion of a trailing stream of the inner flame, to be mixed therewith for a short time, thus enabling high load combustion. For reducing the size of a burner, secondary air is supplied in the form of a laminar flow from the secondary air ports, and then rendered turbulent downstream of the secondary air ports.

Figure 1:
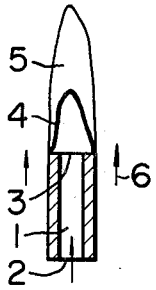
FIG. 1 PRIOR ART
FIGS. 1 and 2 are longitudinal cross-sectional views of conventional gas burners.
Figure 2:
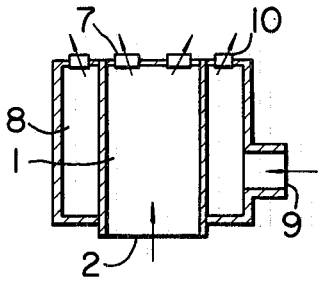
FIG. 2 PRIOR ART
Figure 3:
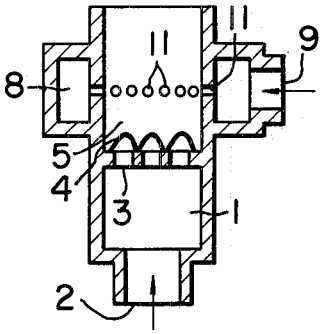
FIG. 3 is a longitudinal cross-sectional view of a gas burner according to one embodiment of the invention.

Description will now be given of one embodiment of the present invention in conjunction with FIG. 3. Reference numerals 1 to 5 designate like parts as shown in FIG. 1. A secondary air passage 8 leads from a secondary air inlet 9 at one end thereof, with the other end communicated with secondary air ports 11 located downstream of flame holes 3. The secondary air jetting through the secondary air ports 11 form a laminar flow and provides a relatively high flow velocity. In addition, the inner flame is so designed as to form a laminar flow.

Figure 4:
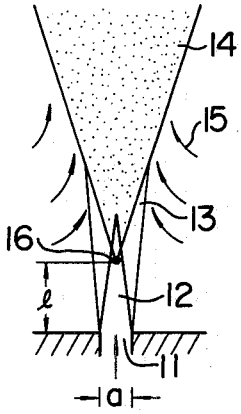
FIG. 4 is a view showing a condition of jet streams.

In operation, secondary air is supplied to a relatively high flow velocity through the secondary air inlet 9 to an outer flame 5 which contains a large amount of CO and $H_2$ and forms a trailing stream of the inner flame 4 at the flame holes 3 as a laminar flow, so that secondary air may be mixed with the outer flame 5 for a short time. In this respect, as has been described earlier with reference to a prior art gas burner in FIG. 1, a mixture gas to be supplied to flame holes is a gas which is provided by mixing fuel and primary air before hand in the form of a laminar flow, so that the size of inner flame 4 is small and less in combustion noise. Although secondary air assumes a laminar flow form at the secondary air ports 11, as shown in FIG. 4, a trailing stream of the secondary air consists of a potential core 12 of a reduced velocity, a laminar flow diffusing layer 13 therearound, and a turbulence zone 14, which is positioned on the trailing side of the core 12 and is diverged through a given angle. A primary combustion gas containing a large amount of CO and $H_2$ from the outer flame 5 and flowing around the turbulence zone 14 is drawn into a jet stream of the secondary air from the secondary air ports, to be mixed therewith, and on the other hand mixed with the outer flame 5 in the turbulence zone 14 due to turbulence produced therein for a quite short time such as 10 ms. After the outer flame 5 has been mixed with secondary air, CO and $H_2$ are completely oxidated for a short time such as 10 ms to 20 ms, thus enabling a high load combustion of the order of $10^7$ kcal/(h·m$^3$). The level of noise produced makes no difference as compared with a noise level in the case of FIG. 1. (Noise of a blower is omitted from the consideration, herein).

In this manner, secondary air is blown in a laminar flow and then changed into a turbulence, so that, in terms of the same flow velocity, the size of secondary air ports may be reduced, if air is blown as a laminar flow rather than if air is blown as a turbulence. As a result, the size of a jet stream may be reduced, with improved mixing of combustion gas with secondary air. This renders the size of a burner smaller.

Figure 5:
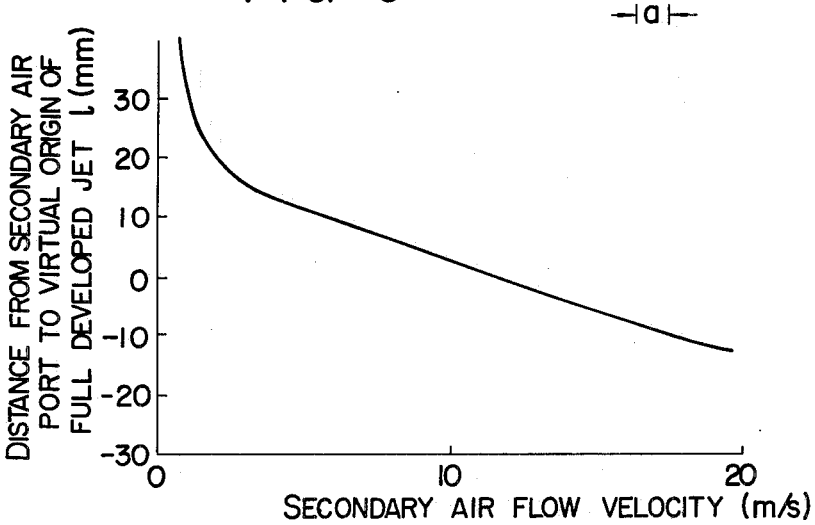
FIG. 5 is a graph showing the relationship between the velocity of a jet stream and distance from a secondary air port to the virtual origin of a fully developed jet.

This description will turn to a velocity of secondary air being blown. FIG. 5 shows the relationship between the velocity of secondary air being blown and a distance l from ports 11 to a virtual origin of the fully developed jet 16 which is the starting point of the turbulence zone 14. In the embodiment in FIG. 5, the width a of secondary air ports 11 is set to 2 mm. In case the velocity of secondary air being blown through the secondary air ports 11 is in the range of 1 to 2 m/s, then the flow of the secondary air gradually shifts to turbulence, so that the distance l up to the virtual origin of the fully developed jet 16 is increased to a large extent, with the result that the primary combustion gas 15 is forcibly drawn into the jet stream of secondary air, resulting in improper mixing of secondary air with the outer flame 5. However, in case the velocity of secondary air being blown exceeds 2 m/s, then the distance l is reduced, so that the primary combustion gas 15 may be drawn into jet streams of secondary air, resulting in thorough mixing of secondary air with the outer flame 5. On the other hand, in case the velocity of secondary air being blown exceeds 10 to 20 m/s, then there results desirable mixing of the outer flame 5 with secondary air, although a pressure loss is increased, thus necessitating an increase in capacity of a blower which is separately provided for supplying secondary air. For these reasons, the velocity of secondary air to be blown should preferably range from 2 to 20 m/s.

Figure 6:
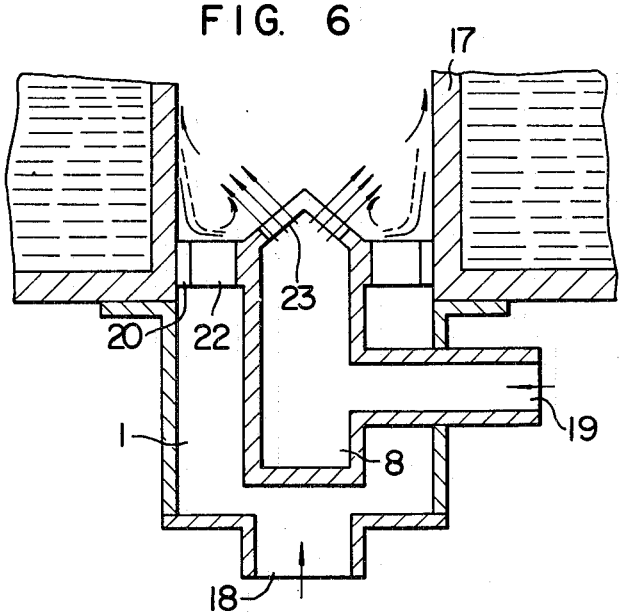
FIG. 6 is a longitudinal cross-sectional view of a gas burner according to one embodiment of the invention.
Figure 7:
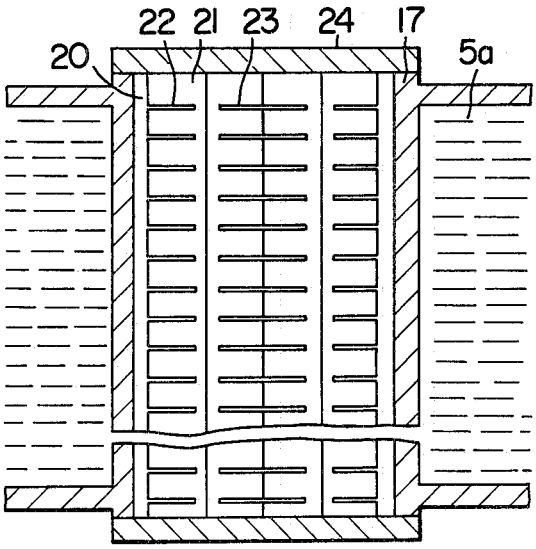
FIG. 7 is a plan view of FIG. 6.

FIGS. 6 and 7 show a modification of the preceding embodiment. Shown at 17 is a combustion chamber, at which air surrounds the outer surface of the combustion chamber to be heated. Shown at 18 is a mixture gas inlet, and at 19 a secondary air inlet, at 20 a main flame hole which is provided in the form of a slot defined between the flame hole plate 21 and the wall 17 of the combustion chamber. Shown at 22 are auxiliary flame holes, at 23 secondary air ports which are provided in the form of a plurality of slits which are directed towards the combustion-chamber walls 17 and are elongated in terms of the direction of a flame. Shown at 24 are side plates closing the sides of a burner in the longitudinal direction thereof. Main flames are formed along the combustion chamber walls 17, while secondary air is blown towards a trailing stream portion of a flame.

The following are the results of a test. In the cases of a combustion calorific power of 3600 Kcal/h, a width of a combustion chamber of 20 mm, its length of 280 mm, a width of slits in the secondary air ports 23 of 0.7 mm, its pitch of 5 mm, and the secondary air being blown at a velocity of 4.5 m/s, then a thermal load of about $3\times10^7$ Kcal/(h·m$^3$) was achieved, with a noise level being the same as that of a Bunsen burner, except for the noise of a blower to supply secondary air.

Figure 8:
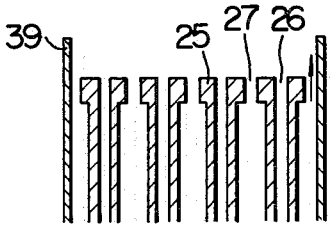
FIG. 8 is a longitudinal cross-sectional view of a gas burner according to one embodiment of the invention.
Figure 9:
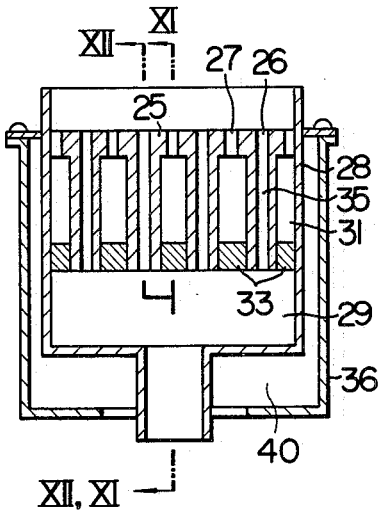
FIG. 9 is a longitudinal cross-sectional, detailed view of the embodiment of FIG. 8.
Figure 10:
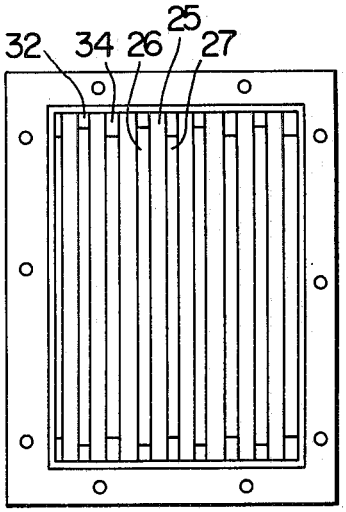
FIG. 10 is a plan view of FIG. 9.
Figure 11:
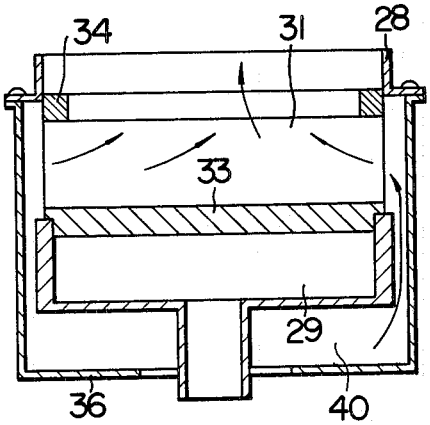
FIG. 11 is a cross-sectional view taken along the line XI—XI of FIG. 9.
Figure 12:
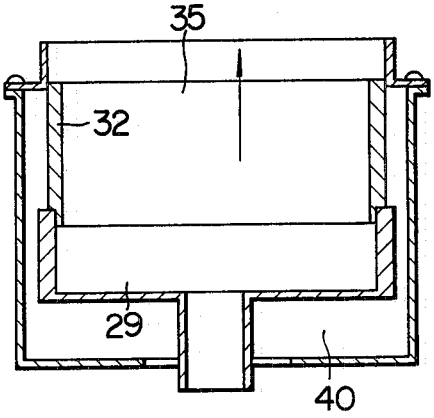
FIG. 12 is a cross-sectional view taken along the line XII—XII of FIG. 9.
Figure 13:
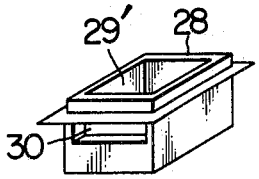
FIG. 13 is a perspective view of an inner box.

In the above embodiment, secondary air is supplied to a mixture gas from the side thereof. Alternatively, as shown in FIG. 8, secondary air may be supplied in the same direction as that of a mixture gas. With the embodiment of FIG. 8, flame holes 26 and secondary air ports 27 are positioned with thick burner walls 25 interposed therebetween, while the flame holes 26 and secondary air ports 27 are provided in a linear form, alternately.

The dimensions of respective parts of a burner are as follows: width of the flame holes 26 . . . 1 mm, width of the secondary air ports 27 . . . 0.8 mm; thickness of the burner wall 25 . . . 2.4 mm; velocity of a mixture gas being blown . . . 1 m/s; velocity of secondary air being blown . . . 6 m/s.

In this respect, in a stagnating zone downstream of the burner walls 25, the thickness of burner walls 25 is 2.4 mm, and there are produced a recirculating stream and small swirls according to the action of the secondary air of a high flow velocity of 6 m/s, enhancing the mixing of a flame with secondary air, and providing stable flames clinging to downstream sides of the burner walls 25. For the reason which has been described earlier in conjunction with FIG. 4, the outer flame may be mixed with secondary air for a short time of about 50 ms quickly, thus enabling low noise, high load combustion. (Since secondary air is supplied in the same direction as an outflowing direction of primary combustion gas, there results slow mixing.)

In the cases of eight flame holes of 1.0 mm×160 mm, and nine secondary air ports 27 of 0.8 mm×156 mm, thermal load of about $8.3\times10^6$ Kcal/(H·m$^3$) was attained, with a noise level being the same as that of a Bunsen burner, except for the noise of a blower to supply secondary air.

A description will be made for the test results given on dimensions and velocities, and their preferable ranges, hereunder. The width of the flame hole 26 should preferably be 0.5 to 3 mm. In case the width of the flame holes 26 is no more than 0.5 mm, then a stable combustion region is reduced, because a boundary velocity gradient is increased. Thus, the above range of width is considered as an allowable minimum dimension. On the other hand, in case the width of the flame holes 26 is no less than 3 mm, then a combustion load is reduced because the outer flame is not mixed quickly with the secondary air, so that the above dimension of 3 mm is considered as an allowable maximum dimension.

The wall thickness of burner walls of 2 to 5 mm is found to be satisfactory. In case the above width is no more than 2 mm, then there results a lifting flame, in the case of a low primary air ratio. Thus, the above dimension of 2 mm is considered as an allowable minimum dimension. On the other hand, in case the above dimension is no less than 5 mm, then there results a need to increase the size of a burner.

The flow velocity of secondary air should preferably range from 2 to 10 m/s. The flow velocity of secondary air is dependent on a stable combustion region, a combustion load, and a capacity of a blower, so that good combustion may be achieved at flow velocities exceeding the above range.

The detailed arrangement of an embodiment of FIG. 8 will be described with reference to FIGS. 9 to 13. Shown at 28 is an inner box having burner walls 25 positioned in its upper portion in side-by-side relation to each other. Defined under the burner walls 25 positioned in side-by-side relation in the inner box 28 is a mixture gas chamber 29. Openings 29', 30 are provided in its top side, and two opposed side walls in their upper portions, respectively, for inserting burner walls 25 therethrough. A secondary air passage 31 defined by the burner walls 25 is communicated sidewise with the opening 30. The burner walls retain spacer plates 32, 33, 34 between each pair of walls in the inner box 28 fixedly therein. The spacer plates 32 define a mixture gas passages 35 therebetween. The spacer plate 33 refines the secondary air passage 31 and a mixture gas chamber 29 on the opposite sides thereof. The inner box of the aforesaid arrangement is placed into an outer box 36, thereby forming a secondary air chamber 40 therebetween. The secondary air is supplied into the secondary air passage 31 from the side thereof.

Figure 14:
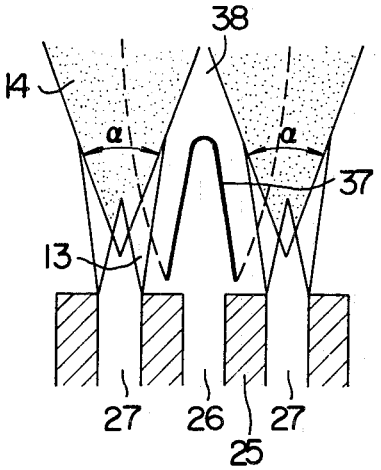
FIG. 14 is a view illustrative of a burning condition.

The fundamental feature of the above burner is such that, as shown in FIG. 14, secondary air slits 27 are positioned on the opposite sides of the flame slits 26, with burner walls 25 interposed therebetween. Noise is produced due to turbulence in the inner flame 37. Accordingly, it is preferable that the inner flame 37 be formed in a stagnating region defined between the two laminar-flow-diffusing layers 13 of jet streams of secondary air, in which less turbulence takes place, and that the outer flame 38 be formed in a turbulence zone 14 which diverges at an angle $\alpha$.

Figure 15:
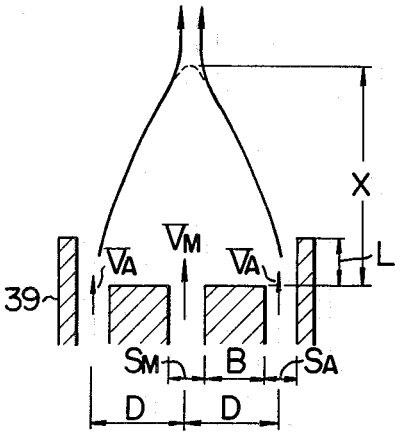
FIG. 15 is a view illustrative of symbols used.
Figure 16:
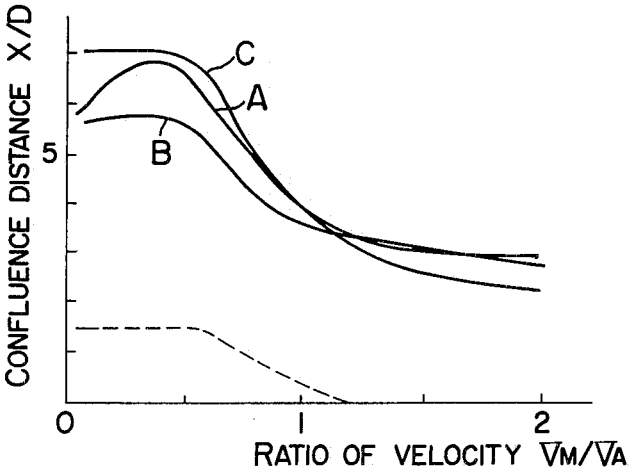
FIG. 16 is a graph representing a characteristic of a distance of a confluence or joining point of streams and a ratio of velocity.

As shown in FIG. 15, two jet streams outside of two-dimensional three jet streams join together downstream thereof. In case a joining or confluence distance of these two jet streams is increased, then interference of a turbulence zone with the inner flame 37 may be prevented. The confluence distance X varies with a velocity of outer jet streams being blown relative to a velocity of a central jet stream as shown in FIG. 16. In FIG. 15, $V_M$ represents a velocity of a mixture gas being blown, $V_A$ a velocity of secondary air being blown, $S_M$ a width of flame slits or mixture charge slits, $S_A$ a width of secondary air slits, B a width of burner walls, D a distance between jet streams, and L a distance from the downstream end of the burner wall to the downstream end of the side wall 39 for the outer jet stream. $V_A$ ranges from 2.4 to 7 m/s in the practical application.

As shown in FIG. 16, in case $V_M/V_A$ is no more than about 0.6, then a confluence distance will be the same as or larger than a mixing distance X/D of two jet streams ($V_M/V_A=0$). Jet streams on both sides of the central stream provide predominant regions, and a maximum confluence distance may be obtained.

In case $V_M/V_A \approx 0.6$ to 1.2, the confluence distance is sharply reduced. This is because of the effect of a central stream drawing both side-jet streams therein.

B is compared with C, at varying lengths of a side wall. Shown by a broken line is $\Delta X/D$ which is obtained by deducting the confluence distance X/D for L=0 from a confluence distance X/D for L=6 mm. In case the side walls 39 are so designed as to project from flame slits, the confluence distance may be increased. With the burner as shown in FIG. 8, in which a plurality of burner units of the aforesaid arrangement are assembled in side-by-side relation, a confluence distance for the inner adjoining jet streams may be increased due to the outer jet streams being drawn together, as compared with a confluence distance shown by curves A and B in FIG. 16, in FIGS. 16A, B, while a confluence distance for the outermost jet streams may be increased by providing the side walls projecting as shown in FIG. 8.

Figure 17:
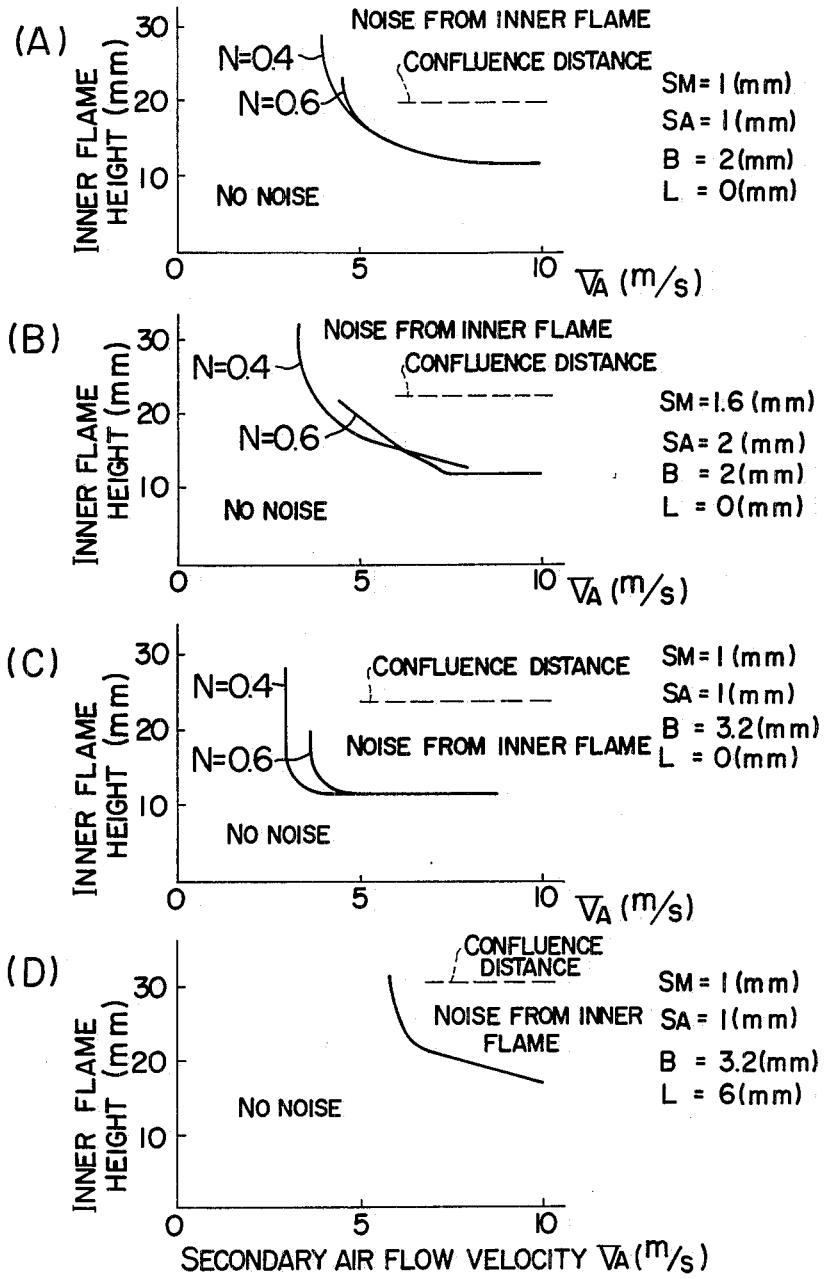
FIGS. 17(A), (B), (C), (D) are graphs representing the relationship between a flow velocity of secondary air and noise produced from an inner flame.

FIG. 17 shows the results of tests given on the generating limit of noise from the inner flame at varying secondary air flow velocities. The type of gas is $CH_4$, and N represents a primary air ratio. In case the secondary air flow velocity is no less than 3 to 5 m/s, generation of noise may be prevented, irrespective of the height (0 to 30 mm) of an inner flame. On the other hand, in case a secondary air flow velocity is no less than 5 m/s, then generation of noise may be prevented, as far as the height of an inner flame is in the range of 0.6 to 0.48 times the confluence distance.

In the preceding embodiments, secondary air is supplied in the form of a laminar flow from the secondary air ports. However, secondary air may be rendered turbulent by mechanical means in the secondary air chamber 40 prior to arriving at each secondary air passage 31 in the embodiment shown in FIGS. 9 and 13. For instance, swirl vanes or blades may be provided in the secondary air chamber 40 to render air turbulent, after which the air is blown from the secondary air ports in the form of turbulence.

What is claimed is:

1. A preliminary mixing type gas burner comprising:

a combustion chamber and means for producing low noise and high load combustion in the combustion chamber;

a flame port means for supplying a predominantly laminar flow of a premixed gaseous fuel and primary air to said combustion chamber, said flame port means being position upstream of a primary combustion zone; and at least one secondary air port means positioned for supplying a predominantly turbulent flow of secondary air to a location within said combustion chamber corresponding to that at which an outer flame portion downstream of a trailing stream of an inner flame is formed around said flame port means in use.

2. A gas burner, as set forth in claim 1, further comprising outlet means, arranged on said secondary air port means, for supplying a predominantly laminar flow of secondary air of a relatively high velocity when the secondary air flows from the secondary air port means.

3. A gas burner, as set forth in claim 2, wherein said secondary air port and outlet means comprise means for supplying said laminar flow at a velocity of 2 meters/-second or higher.

4. A gas burner, as set forth in claim 3, wherein the velocity of said laminar flow of secondary air supplied by said means for supplying is between 2 and 10 meters/second.

5. A gas burner, as set forth in claim 1, wherein the secondary air port means are so arranged with respect to the flame port means that the secondary air supplied to the outer flame flows from at least one lateral side of the inner flame.

6. A gas burner, as set forth in claim 1, wherein the secondary air port means are so arranged with respect to the flame port means that the secondary air supplied to the outer flame flows in the same direction as that of the inner flame.

7. A gas burner, as set forth in claim 5, wherein the secondary air port means are arranged at two lateral sides of the flame port means.

8. A gas burner, as set forth in claim 1, further comprising burner walls disposed between the flame port means and the secondary air port means.

9. A gas burner, as set forth in claim 1, wherein the flame port means are rectangularly shaped.

10. A gas burner, as set forth in claim 6, further comprising outlet means, arranged on said secondary air port means, for supplying a laminar flow of secondary air of a relatively high velocity when the secondary air flows from the secondary air port means.

11. A gas burner, as set forth in claim 2, wherein a ratio of a velocity of the flow of the premixed gaseous fuel and primary air from the flame port means to a velocity of the flow of secondary air from the outlet means of the secondary air port means is 0.6 or smaller.

12. A gas burner, as set forth in claim 4, wherein the velocity of said laminar flow of secondary air supplied by said means for supplying is between 2 and 5 meters/-second.

13. A gas burner, as set forth in claim 3, wherein the velocity of said laminar flow of secondary air supplied by said means for supplying is between 2 and 5 meters/-second.

14. A gas burner, as set forth in claim 7, wherein the ratio of the height of the inner flame to the confluence distance of the secondary air supplied from the secondary port means, arranged at the two lateral sides of the flame port means, is 0.6 or smaller.

15. A gas burner, as set forth in claim 13, wherein the ratio of the height of the inner flame to the confluence distance of the secondary air supplied from the secondary port means, arranged at the two lateral sides of the flame port means, is 0.6 or smaller.

16. A gas burner, as set forth in claim 1, further comprising mechanical means for imparting turbulent flow to the secondary air, said mechanical means being arranged inside of said secondary air port means.

17. A gas burner, as set forth in claim 1, further comprising a combustion chamber wall means for contacting the outer flame, said wall means being provided at one side of the flame port means.

18. A gas burner, as set forth in claim 17, wherein the secondary air port means are so arranged with respect to the flame port means that the secondary air is directed towards the combustion chamber wall means.

19. A gas burner, as set forth in claim 17, wherein the flame port means is arranged in contact with the combustion chamber wall means.

20. A gas burner, as set forth in claim 18, wherein the flame port means is arranged in contact with the combustion chamber wall means.

21. A gas burner, as set forth in claim 18, wherein the secondary air port means are so arranged to impart to the flow of secondary air a component in the direction of extension of the combustion chamber wall means and a component in the direction of the flow of the premixed gaseous fuel and primary air from the flame port means.

22. A gas burner, as set forth in claim 17, wherein the flame port means has a main flame port and an auxiliary flame port, said main flame port being located closer to the combustion chamber wall means and said auxiliary flame port being located closer to the secondary air port means.

23. A preliminary mixing type gas burner comprising:

a combustion chamber;

a flame port means for supplying a laminar flow of a premixed gaseous fuel and primary air to said combustion chamber, wherein the flame port means has a main flame port and an auxiliary flame port, said main flame port being located closer to the combustion chamber wall means and said auxiliary flame port being located closer to the secondary air port means;

at least one secondary air port means for supplying a turbulent flow of secondary air to an outer flame portion downstream of a trailing stream of an inner flame formed around said flame port means;

whereby low noise and high load combustion is produced in the combustion chamber; and a combustion chamber wall means for contacting the outer flame, said wall means being provided at one side of the flame port means.

* * * * *